US008774688B2

(12) United States Patent
Okamoto et al.

(10) Patent No.: US 8,774,688 B2
(45) Date of Patent: Jul. 8, 2014

(54) IMAGE FORMING APPARATUS WITH LEADING-END AND TRAILING-END HOLDING MEMBERS TO PREVENT SAGGING OF RECORDING MEDIUM DURING TRANSPORTATION

(75) Inventors: Tetsuji Okamoto, Kanagawa (JP); Atsushi Ogihara, Kanagawa (JP); Wataru Suzuki, Kanagawa (JP); Koichi Watanabe, Kanagawa (JP); Shuichi Nishide, Kanagawa (JP); Masahiro Sato, Kanagawa (JP); Atsuyuki Kitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 152 days.

(21) Appl. No.: 13/371,053

(22) Filed: Feb. 10, 2012

(65) Prior Publication Data

US 2013/0071151 A1 Mar. 21, 2013

(30) Foreign Application Priority Data

Sep. 21, 2011 (JP) ..... 2011-206194

(51) Int. Cl.
*G03G 15/01* (2006.01)

(52) U.S. Cl.
USPC ..... 399/304

(58) Field of Classification Search
USPC ..... 399/304
See application file for complete search history.

(56) References Cited

U.S. PATENT DOCUMENTS

| | | | | |
|---|---|---|---|---|
| 2011/0236081 | A1* | 9/2011 | Okamoto et al. | 399/304 |
| 2011/0318067 | A1* | 12/2011 | Okamoto et al. | 399/304 |
| 2012/0230739 | A1* | 9/2012 | Okamoto et al. | 399/304 |
| 2013/0078012 | A1* | 3/2013 | Sato et al. | 399/304 |
| 2013/0223895 | A1* | 8/2013 | Ogihara et al. | 399/304 |
| 2013/0223896 | A1* | 8/2013 | Nishide et al. | 399/304 |
| 2013/0223897 | A1* | 8/2013 | Okamoto et al. | 399/304 |
| 2013/0223898 | A1* | 8/2013 | Sato et al. | 399/304 |

FOREIGN PATENT DOCUMENTS

| | | |
|---|---|---|
| JP | 63-293573 A | 11/1988 |
| JP | 07-271206 A | 10/1995 |

* cited by examiner

*Primary Examiner* — G. M. Hyder
(74) *Attorney, Agent, or Firm* — Sughrue Mion, PLLC

(57) ABSTRACT

An image forming apparatus includes an image carrying member, a transfer member, a leading-end holding member, and a trailing-end holding member. The leading-end holding member is mounted on the transfer member and holds, on an outer peripheral surface of the transfer member, a leading-end portion of a recording medium fed to a sheet feeding position that is further upstream than a transfer position in a rotation direction of the transfer member. The trailing-end holding member rotates along the outer peripheral surface. The trailing-end holding member presses the recording medium against the outer peripheral surface while waiting at a waiting position that is further upstream than the transfer position and downstream than the sheet feeding position, and holds a trailing end portion on the outer peripheral surface while rotating together with the transfer member when the trailing end portion of the recording medium arrives at the waiting position.

6 Claims, 6 Drawing Sheets

IMAGE FORMING APPARATUS WITH LEADING-END AND TRAILING-END HOLDING MEMBERS TO PREVENT SAGGING OF RECORDING MEDIUM DURING TRANSPORTATION

CROSS-REFERENCE TO RELATED APPLICATIONS

This application is based on and claims priority under 35 USC 119 from Japanese Patent Application No. 2011-206194 filed Sep. 21, 2011.

BACKGROUND

(i) Technical Field

The present invention relates to an image forming apparatus.

SUMMARY

According to an aspect of the invention, an image forming apparatus includes an image carrying member, a transfer member, a leading-end holding member, and a trailing-end holding member. The image carrying member is disposed rotatably and carries an image on an outer peripheral surface thereof. The transfer member is rotatably disposed so as to face the image carrying member. The transfer member transfers the image formed on the image carrying member to a recording medium that is interposed between the transfer member and the image carrying member at a transfer position at which the transfer member faces the image carrying member. The leading-end holding member is mounted on the transfer member and holds a leading-end portion, in a transport direction, of the recording medium onto an outer peripheral surface of the transfer member, the recording medium being fed to a sheet feeding position that is further upstream than the transfer position in a rotation direction of the transfer member. The trailing-end holding member is disposed so as to be capable of rotating along the outer peripheral surface of the transfer member. The trailing-end holding member presses the recording medium having the leading end portion in the transport direction held by the leading-end holding member against the outer peripheral surface of the transfer member while waiting at a waiting position that is further upstream than the transfer position and further downstream than the sheet feeding position in the rotation direction of the transfer member, and holds a trailing end portion, in the transport direction, of the recording medium onto the outer peripheral surface of the transfer member while rotating so as to follow rotation of the transfer member when the trailing end portion, in the transport direction, of the recording medium arrives at the waiting position.

BRIEF DESCRIPTION OF THE DRAWINGS

Exemplary embodiment(s) of the present invention will be described in detail with reference to the following figures, wherein.

DETAILED DESCRIPTION

Referring to attached drawings, an exemplary embodiment of the present invention will be described in detail below.

Figure 1:
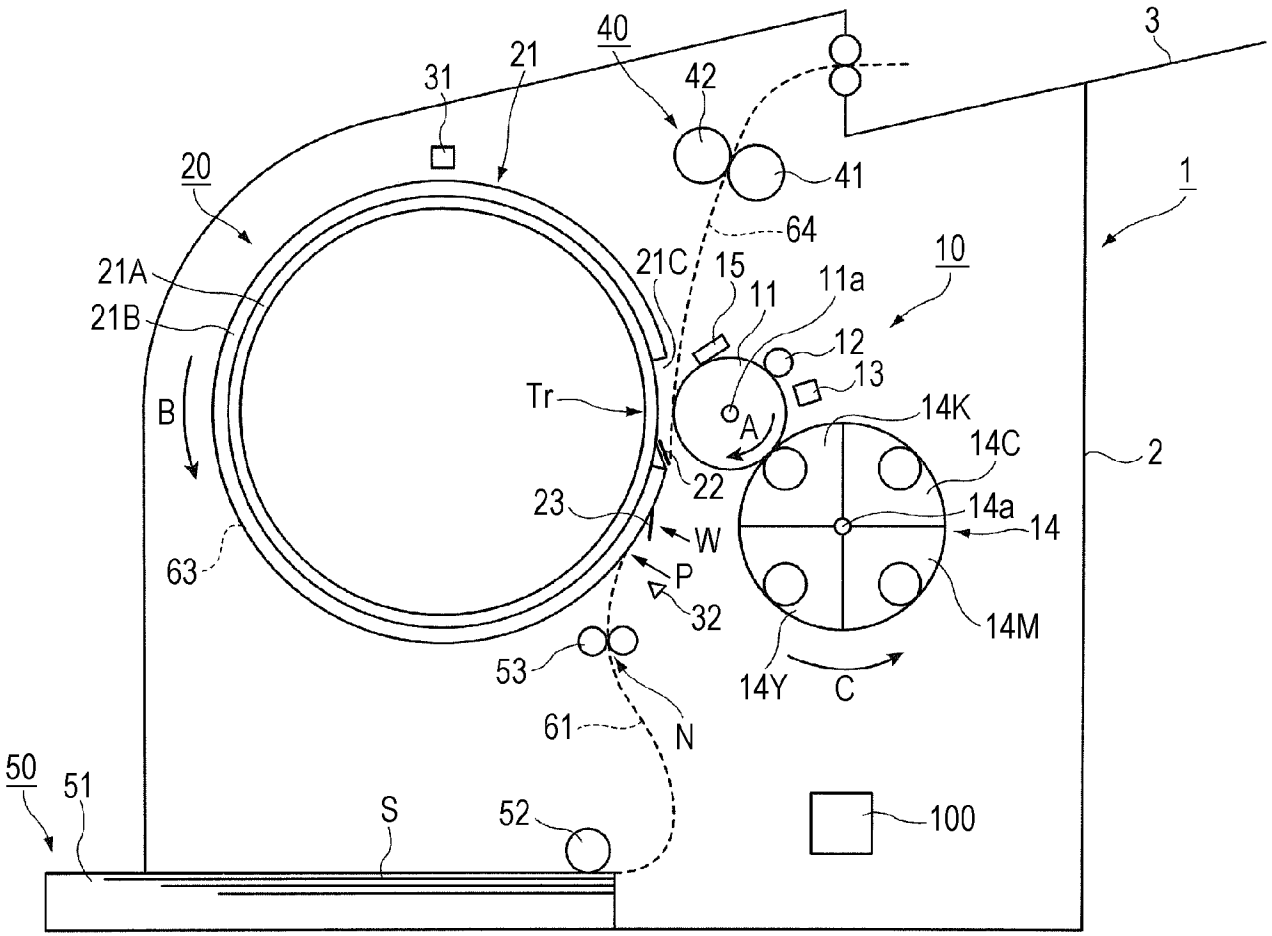
FIG. 1 illustrates an entire configuration of an image forming apparatus according to an exemplary embodiment.

FIG. 1 illustrates an example of an entire configuration of an image forming apparatus 1 according to the exemplary embodiment.

The image forming apparatus 1 includes an image forming unit 10 that forms a toner image, a transfer unit 20 that transfers the toner image formed by the image forming unit 10 to a sheet S, a fixing unit 40 that fixes, on the sheet S, the toner image transferred by the transfer unit 20 to the sheet S, and a sheet feeding unit 50 that feeds the sheet S to the transfer unit 20 in order for the transfer unit 20 to transfer the toner image to the sheet S. The image forming apparatus 1 further includes a controller 100 that controls operations of the image forming unit 10, the transfer unit 20, the fixing unit 40, the sheet feeding unit 50, and other components. Here, components of the image forming apparatus 1 are housed in a casing 2. The casing 2 has an output sheet pile portion 3, which allows sheets S output from the fixing unit 40 to be piled thereon, in an upper portion thereof.

Among these units, the image forming unit 10 includes a photoconductor drum 11, a charging device 12 that charges the photoconductor drum 11, an exposure device 13 that exposes the charged photoconductor drum 11 with light, a rotary developing device 14 that develops with toner an electrostatic latent image formed on the photoconductor drum 11 by the charging and exposing operations, and a cleaning device 15 that removes toner or the like remaining on the photoconductor drum 11 after a transfer operation of the developed toner image.

The photoconductor drum 11, which is an example of an image carrying member, has a photosensitive layer (not illustrated) at a surface (an outer peripheral surface) thereof. The photoconductor drum 11 rotates in the arrow A direction about a rotation shaft 11*a*. The charging device 12, the exposure device 13, the rotary developing device 14, and the cleaning device 15 are arranged in this order in the arrow A direction around the periphery of the photoconductor drum 11. Here, the outside diameter of the photoconductor drum 11 is, for example, 30 mm.

The charging device 12 is an electric-discharging device of the contact roller type in the exemplary embodiment, and charges the photoconductor drum 11 while rotating together with the photoconductor drum 11.

The exposure device 13 forms an electrostatic latent image by selectively irradiating the charged surface of the photoconductor drum 11 with light. The exposure device 13 according to the exemplary embodiment includes multiple light emitting elements (LEDs, for example) arranged in the axial direction of the photoconductor drum 11.

The rotary developing device 14 includes a rotation shaft 14*a* that extends in the axial direction of the rotation shaft 11*a* of the photoconductor drum 11, and yellow (Y), magenta (M), cyan (C), and black (K) developing portions 14Y, 14M, 14C, and 14K that are arranged around the rotation shaft 14*a*. The rotary developing device 14 rotates in the arrow C direction about the rotation shaft 14*a* and one of the developing portions stops in a facing region in which the developing portion faces the photoconductor drum (referred to as a developing position, below). The rotary developing device 14 develops an electrostatic latent image formed on the photoconductor drum 11 by the exposure device 13 with toner of the corresponding developing portion that has stopped at the developing position. The outside diameter of the rotary developing device 14 is, for example, 100 mm.

The cleaning device 15 removes toner remaining on the surface of the photoconductor drum 11 and extraneous matter other than the toner. The cleaning device 15 according to the exemplary embodiment is a blade cleaner that comes into contact with the surface of the photoconductor drum 11.

The transfer unit 20 includes a transfer drum 21, a leading-end gripper 22, and a trailing-end gripper 23. The transfer drum 21 faces the photoconductor drum 11, extends in the axial direction of the rotation shaft 11*a* of the photoconductor drum 11, and is arranged so as to be rotatable. The leading-end gripper 22 grips an end portion of a sheet S, which is a leading-end portion in a transport direction, on the outer peripheral surface of the transfer drum 21. The trailing-end gripper 23 grips an end portion of a sheet S, which is a trailing-end portion in a transport direction, on the outer peripheral surface of the transfer drum 21. Here, the transfer drum 21 rotates in the arrow B direction that coincides with the rotation direction of the photoconductor drum 11 (arrow A direction) in a facing region in which the transfer drum 21 faces the photoconductor drum 11. The outside diameter of the transfer drum 21 is, for example, 120 mm. In the exemplary embodiment, the outside diameter of the transfer drum 21 is set to be larger than the outside diameter of the photoconductor drum 11, as described above.

The transfer drum 21, which is an example of a transfer member, includes a substantially cylindrical base portion 21A and an elastic layer 21B mounted on the outer peripheral surface of the base portion 21A. Here, the elastic layer 21B covers the outer peripheral surface of the base portion 21A, excluding a region that extends in an axial direction of the base portion 21A. That is, the elastic layer 21B has a C-shaped section. The region of the outer peripheral surface of the base portion 21A of the transfer drum 21 that is not covered by the elastic layer 21B is defined as an exposed portion 21C from which the base portion 21A is exposed.

The base portion 21A according to the exemplary embodiment is formed by an electrically conductive hollow tube made of, for example, a metal. On the other hand, the elastic layer 21B is made of a semiconductive elastic material containing a foam material. For example, a resin such as a polyurethane resin containing an electrically conductive material is used as the elastic layer 21B.

A transfer power supply that is not illustrated applies a transfer bias with a polarity that is opposite to the polarity of the toner, to the base portion 21A. The photoconductor drum 11 is grounded.

In the following description, the position at which the photoconductor drum 11 and the transfer drum 21 face each other is referred to as a transfer position Tr. In the exemplary embodiment, the photosensitive layer of the photoconductor drum 11 and the elastic layer 21B of the transfer drum 21 come into contact with each other at the transfer position Tr, and thus function as a transfer nip portion. Note that, when the exposed portion 21C of the transfer drum 21 is located at the transfer position Tr, the photoconductor drum 11 and the exposed portion 21C do not come into contact with each other.

The leading-end gripper 22, which is an example of a leading-end holding member, is disposed on the outer peripheral surface of the transfer drum 21 at a portion in the exposed portion 21C that is a leading end portion in the rotation direction of the elastic layer 21B so as to extend in the axial direction of the transfer drum 21. The leading-end gripper 22 is attached to the base portion 21A of the transfer drum 21 and rotates so as to follow the rotation of the transfer drum 21.

On the other hand, the trailing-end gripper 23, which is an example of a trailing-end holding member, is arranged so as to be capable of rotating along the outer peripheral surface of the transfer drum 21, and thus is allowed to rotate and stop rotating independent of the transfer drum 21. Thus, in the exemplary embodiment, the positional relationship (distance) between the leading-end gripper 22 and the trailing-end gripper 23 on the outer peripheral surface of the transfer drum 21 is changeable.

The fixing unit 40 includes a heating roller 41 and a compressing roller 42. The heating roller 41 includes a heating source (not illustrated) and is arranged so as to be rotatable. The compressing roller 42 is arranged so as to be in contact with the heating roller 41 and thus forms a fixing nip portion together with the heating roller 41.

The sheet feeding unit 50 includes a sheet containing portion 51, a pick-up roller 52, and a pair of feed rollers 53. The sheet containing portion 51 is disposed below the transfer drum 21 and contains sheets S therein, which are examples of a recording medium. The pick-up roller 52 picks up the sheets S from the sheet containing portion 51. The pair of feed rollers 53 feed the sheets S picked up by the pick-up roller 52 to the transfer drum 21 at appropriate timings.

In the following description, a transport path of the sheets S from the sheet containing portion 51 to the transfer drum 21 via the feed rollers 53 is referred to as a sheet feeding path 61. A transport path of the sheets S on the outer peripheral surface of the transfer drum 21 is referred to as a rotational path 63. A transport path of the sheets S from the transfer position Tr to the output sheet pile portion 3 via the fixing unit 40 is referred to as a sheet output path 64. Further, a portion of the sheet feeding path 61 that meets the outer peripheral surface of the transfer drum 21 is referred to as a sheet feeding position P, and a portion of the sheet feeding path 61 that faces the pair of feed rollers 53 is referred to as a feed nip portion N.

In the image forming apparatus 1, the sheet feeding position P is on a side that is further upstream than the transfer position Tr in the rotation direction of the transfer drum 21 (arrow B direction). As illustrated in FIG. 1, the trailing-end gripper 23 is normally stationary at a waiting position W. The waiting position W is positioned on a side that is further upstream than the transfer position Tr but further downstream than the sheet feeding position P in the rotation direction of the transfer drum 21 (arrow B direction).

The image forming apparatus 1 according to the exemplary embodiment further includes a phase sensor 31 that measures the phase of the rotating transfer drum 21, and a sheet detecting sensor 32 that detects the sheets S passing through the sheet feeding position P. The phase sensor 31 is positioned so as to face the outer peripheral surface of the transfer drum 21. The phase sensor 31 detects marks (not illustrated) on the outer peripheral surface of the transfer drum 21 and thus measures the phase of the rotating transfer drum 21. The sheet detecting sensor 32 is positioned at the sheet feeding position P so as to face the outer peripheral surface of the transfer drum 21. The sheet detecting sensor 32 detects a sheet S that has been fed along the sheet feeding path 61 and a sheet S that has been transported along the rotational path 63.

Now, the transfer drum 21, the leading-end gripper 22, and the trailing-end gripper 23, which form the transfer unit 20, will be further described in detail.

Figure 2:
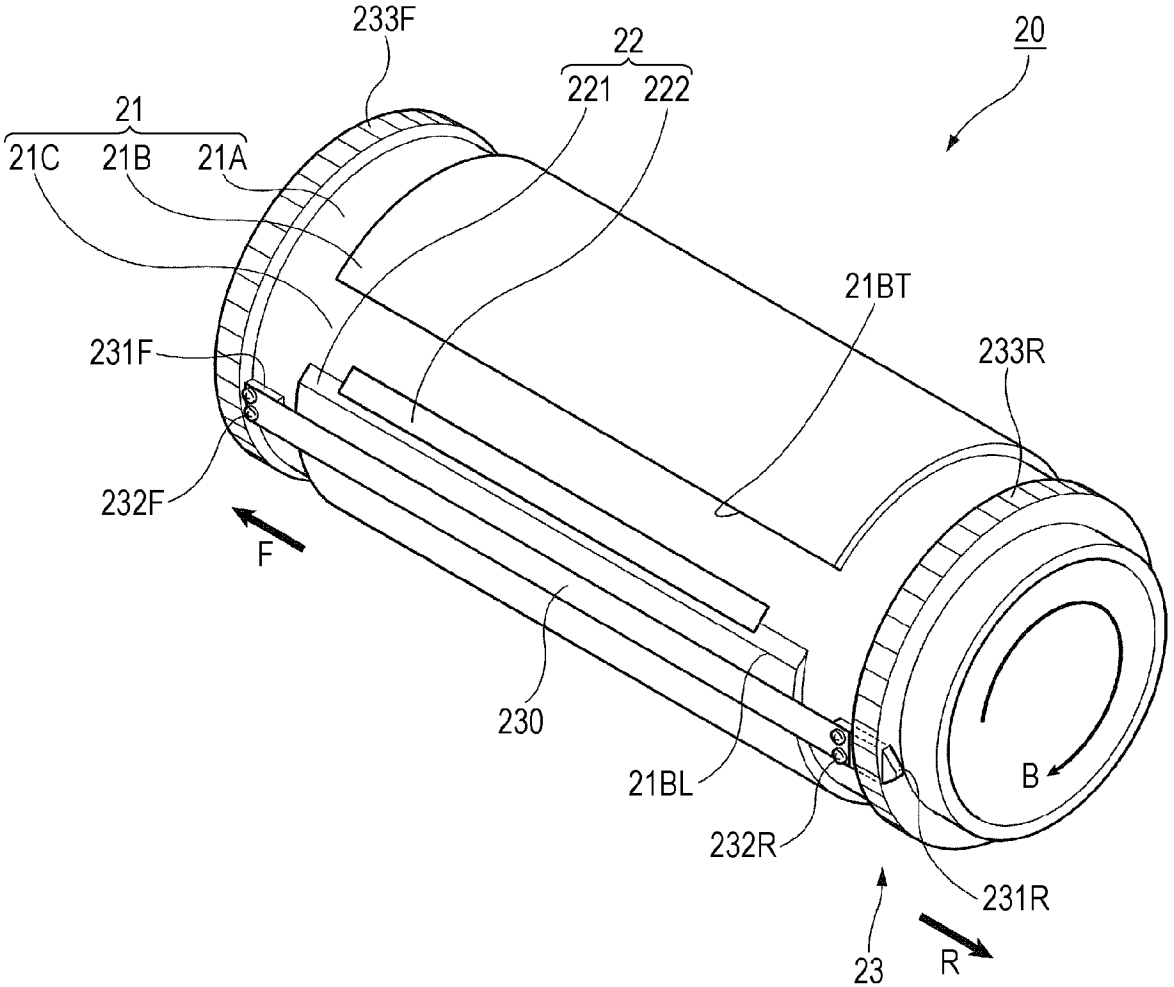
FIG. 2 is a perspective view illustrating an entire configuration of a transfer unit.
Figure 3:
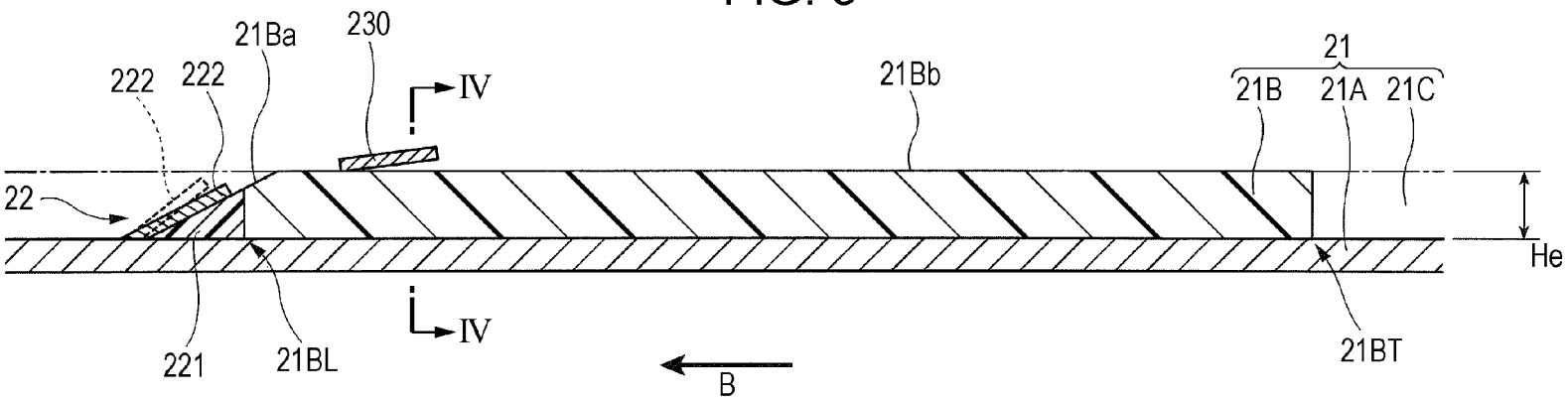
FIG. 3 is a sectional view of a circumferential portion of the transfer unit.
Figure 4:
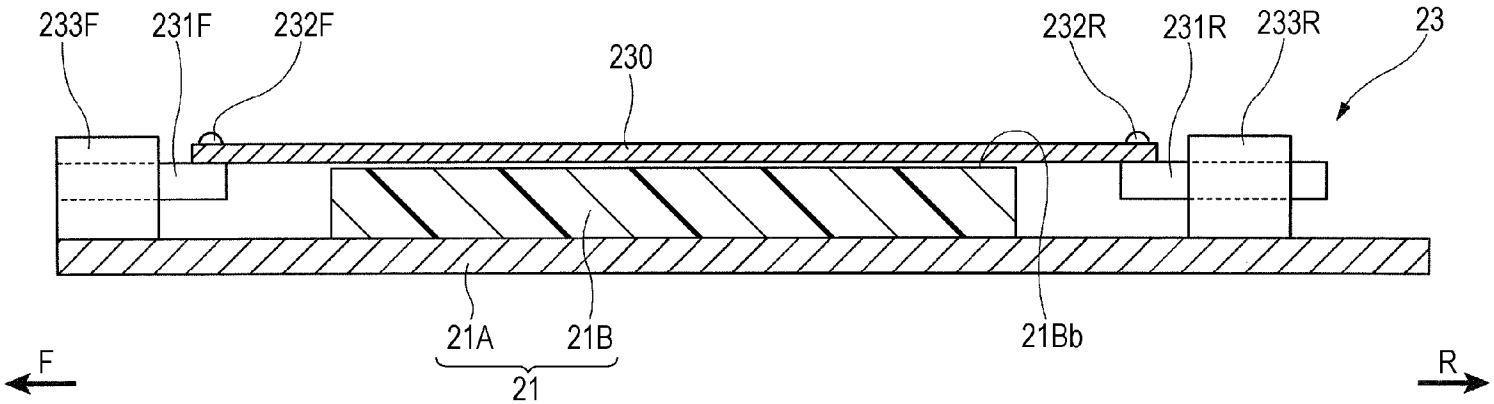
FIG. 4 is a sectional view of the transfer unit taken along line IV-IV of FIG. 3.

FIG. 2 is a perspective view illustrating an entire configuration of the transfer unit 20. FIG. 3 is a sectional view of a circumferential portion of the transfer unit 20 (the transfer drum 21, the leading-end gripper 22, and the trailing-end gripper 23). FIG. 4 is a sectional view of the transfer unit 20 taken along line IV-IV of FIG. 3. In the transfer unit 20 illustrated in FIG. 2, the upper left side in FIG. 2 corresponds to the front side in FIG. 1 (denoted by the reference symbol F) and the lower right side in FIG. 2 corresponds to the rear side in FIG. 1 (denoted by the reference symbol R). FIG. 3 is a developed diagram in which a cross section of a circumferential portion the transfer unit 20 is developed in a linear form. Actually, the left end and the right end of the base portion 21A illustrated in FIG. 3 are connected to each other. FIG. 4 is a sectional view of the transfer drum 21 and the trailing-end gripper 23 of the transfer unit 20 taken in the axial direction of the transfer unit 20.

As described above, the transfer drum 21 according to the exemplary embodiment includes the substantially cylindrical base portion 21A and the elastic layer 21B that is mounted on the outer peripheral surface of the base portion 21A in the region excluding two axial-end portions of the base portion 21A and the exposed portion 21C. The transfer drum 21 is rotated by a driving force from a driving roller (not illustrated), which is positioned so as to be in contact with, for example, the inner peripheral surface of the base portion 21A. An end portion of the elastic layer 21B to which the leading-end gripper 22 is mounted is referred to as an elastic-layer leading end 21BL, and an end portion that is opposite to the elastic-layer leading end 21BL is referred to as an elastic-layer trailing end 21BT. In the elastic layer 21B, the elastic-layer leading end 21BL is positioned on a side that is further upstream than the elastic-layer trailing end 21BT in the direction of rotation of the transfer drum 21 (arrow B direction). The elastic layer 21B has an inclined surface 21Ba on a side that is near the elastic-layer leading end 21BL. The inclined surface 21Ba is formed such that the thickness of the elastic layer 21B becomes larger toward the upstream side in the rotation direction of the transfer drum 21. The elastic layer 21B also has a flat surface 21Bb that extends from an upstream-side end portion of the inclined surface 21Ba to the elastic-layer trailing end 21BT. The flat surface 21Bb is formed such that the elastic layer 21B has a substantially uniform thickness. In the transfer drum 21, the distance between the outer peripheral surface of the base portion 21A and the flat surface 21Bb of the elastic layer 21B is referred to as the elastic-layer height He. Note that the flat surface 21Bb actually has a curved sectional shape, but is expressed as being "flat" here, because the distance from the rotational center of the transfer drum 21 to the flat surface 21Bb (radius) is substantially uniform.

Next, a configuration of the leading-end gripper 22 will be described.

The leading-end gripper 22 according to the exemplary embodiment extends in the axial direction of the transfer drum 21 in the exposed portion 21C of the transfer drum 21. The leading-end gripper 22 includes a platform 221 and a nip board 222. The platform 221 is fixed to the base portion 21A while being adjacent to the elastic-layer leading end 21BL of the elastic layer 21B. The nip board 222 is openable and closable with respect to the platform 221 and nips the leading end portion of a sheet S together with the platform 221 when being in the closed state.

In the illustrated example, the platform 221 has a wedge-shaped (more specifically, an almost right-triangular) cross section and is attached to the base portion 21A such that the thickness of the platform 221 increases from the downstream side to the upstream side in the rotation direction of the transfer drum 21. Also in the illustrated example, an upper surface of the platform 221 (the surface that forms a hypotenuse in the cross section) and the inclined surface 21Ba of the elastic layer 21B form a continuous surface in a boundary portion between the platform 221 and the elastic layer 21B. Thus, the height of the platform 221 from the outer peripheral surface of the base portion 21A (the maximum height) is smaller than the elastic-layer height He of the elastic layer 21B. The platform 221 may be made of an elastic material having a high friction coefficient, such as polyurethane. The elastic layer 21B and the platform 221 may be made of the same material in an integrated manner.

On the other hand, the nip board 222 pivotally turns around a shaft (not illustrated) attached to the base portion 21A in the axial direction of the transfer drum 21, so that the nip board 222 comes into contact with the upper surface of the platform 221 (as illustrated by the solid line in FIG. 3) or becomes separated from the upper surface of the platform 221 (as illustrated by the broken line in FIG. 3). The nip board 222 is made of a metal material, such as a stainless steel. When the nip board 222 is in the former state, i.e., comes in contact with the platform 221, the nip board 222 grips the leading end portion of the sheet S, which is a leading end portion in the transport direction and referred to as a leading end portion below, between itself and the transfer drum 21, and releases the leading end portion when in the latter state, i.e., becomes separated from the leading end portion. In the following description, the state of the leading-end gripper 22 (as illustrated by the solid line in FIG. 3) for the case where the leading-end gripper 22 grips the sheet S between itself and the transfer drum 21 is referred to as a "closed" state, while the state of the leading-end gripper 22 (as illustrated by the broken line in FIG. 3) for the case where the leading-end gripper 22 does not grip the sheet S between itself and the transfer drum 21 is referred to as an "open" state.

In the illustrated example, a free end of the nip board 222 from the outer peripheral surface of the base portion 21A is positioned at a level that is lower than the elastic-layer height He in both cases where the leading-end gripper 22 is in the closed state and the open state. In other words, in the exemplary embodiment, the nip board 222 of the leading-end gripper 22 does not project beyond the flat surface 21Bb of the elastic layer 21B even when being in the open state. Furthermore, the leading-end gripper 22 is positioned so as not to come into contact with the photoconductor drum 11 at the transfer position Tr.

Now, a configuration of the trailing-end gripper 23 will be described.

The trailing-end gripper 23 according to the exemplary embodiment includes a strip-like pressing sheet 230. The pressing sheet 230 faces the outer peripheral surface of the transfer drum 21, extends in the axial direction of the transfer drum 21, and presses the sheet S fed to the transfer drum 21 against the elastic layer 21B. The trailing-end gripper 23 further includes a front support body 231F that supports a front end of the pressing sheet 230, a rear support body 231R that supports a rear end of the pressing sheet 230, a front lock screw 232F with which the pressing sheet 230 is fastened to the front support body 231F, and a rear lock screw 232R with which the pressing sheet 230 is fastened to the rear support body 231R. The trailing-end gripper 23 further includes a front driving gear 233F and a rear driving gear 233R. The front driving gear 233F is fitted onto the outer peripheral surface of the base portion 21A in a front end portion of the transfer drum 21 so as to be rotatable, holds the front support body 231F and is driven to rotate by an external device. The rear driving gear 233R is fitted onto the outer peripheral surface of the base portion 21A in a rear end portion of the transfer drum 21 so as to be rotatable, holds the rear support body 231R and is driven to rotate by an external device.

The pressing sheet 230, which is an example of a strip member in the exemplary embodiment, is made of a resin material such as polyimide, and has such a thickness that the pressing sheet 230 is capable of bending when, for example, being pressed so as to approach or move farther from the elastic layer 21B. The pressing sheet 230 according to the exemplary embodiment is supported by the front support body 231F and the rear support body 231R obliquely with respect to the elastic layer 21B of the transfer drum 21. More specifically, the pressing sheet 230 is disposed such that the gap between itself and the upper surface of the elastic layer 21B (flat surface 21Bb) increases from the downstream side to the upstream side in the rotation direction of the transfer drum 21. In the illustrated example in FIG. 3, an end portion of the pressing sheet 230 that is on the downstream side in the rotation direction of the transfer drum 21 comes into contact with the flat surface 21Bb of the elastic layer 21B. In FIG. 4, which is a sectional view of the transfer unit 20 taken along line IV-IV of FIG. 3, the flat surface 21Bb of the elastic layer 21B and the pressing sheet 230 are separated from each other.

The front support body 231F that supports one end of the pressing sheet 230 is fitted into a through hole formed in the front driving gear 233F. The rear support body 231R that supports the other end of the pressing sheet 230 is fitted into a through hole formed in the rear driving gear 233R. The front support body 231F is mounted on the front driving gear 233F while being restrained from moving in the axial direction of the transfer drum 21. On the other hand, the rear support body 231R is mounted on the rear driving gear 233R while being allowed to move in the axial direction of the transfer drum 21. To be more specific, when the rear support body 231R is mounted on the rear driving gear 233R, the rear support body 231R is pressed so as to be moved farther from the front support body 231F, or pressed rearward, by a spring that is not illustrated. Consequently, a tension in the axial direction of the transfer drum 21 is applied to the pressing sheet 230.

The front driving gear 233F and the rear driving gear 233R each have a ring shape. The front driving gear 233F and the rear driving gear 233R each have multiple teeth, which form a gear, on the outer peripheral surface thereof and a rolling bearing (not illustrated) on the inner peripheral surface thereof. The front driving gear 233F and the rear driving gear 233R are each attached to the base portion 21A of the transfer drum 21 via the corresponding rolling bearing attached to the inner peripheral surface thereof. Thus, in the transfer unit 20, rotational driving of the transfer drum 21 via the inner peripheral surface of the base portion 21A is allowed to be performed independently of rotational driving of the pressing sheet 230 via the front driving gear 233F and the rear driving gear 233R. The front driving gear 233F and the rear driving gear 233R are driven and stopped in synchronization with each other. The pressing sheet 230 rotates along the outer peripheral surface of the transfer drum 21 while extending in the axial direction of the transfer drum 21.

Next, an image forming operation performed by the image forming apparatus illustrated in FIG. 1 will be described. The image forming apparatus 1 is capable of performing an operation for forming a multi-color image on a single sheet S using two to four colors of toner among yellow, magenta, cyan, and black. The image forming apparatus 1 is also capable of performing an operation for forming a single-color image on a single sheet S using a single color of toner among yellow, magenta, cyan, and black. Here, a case where a full color image is formed on a single sheet S using four colors of toner will be taken as an example.

Figure 5:
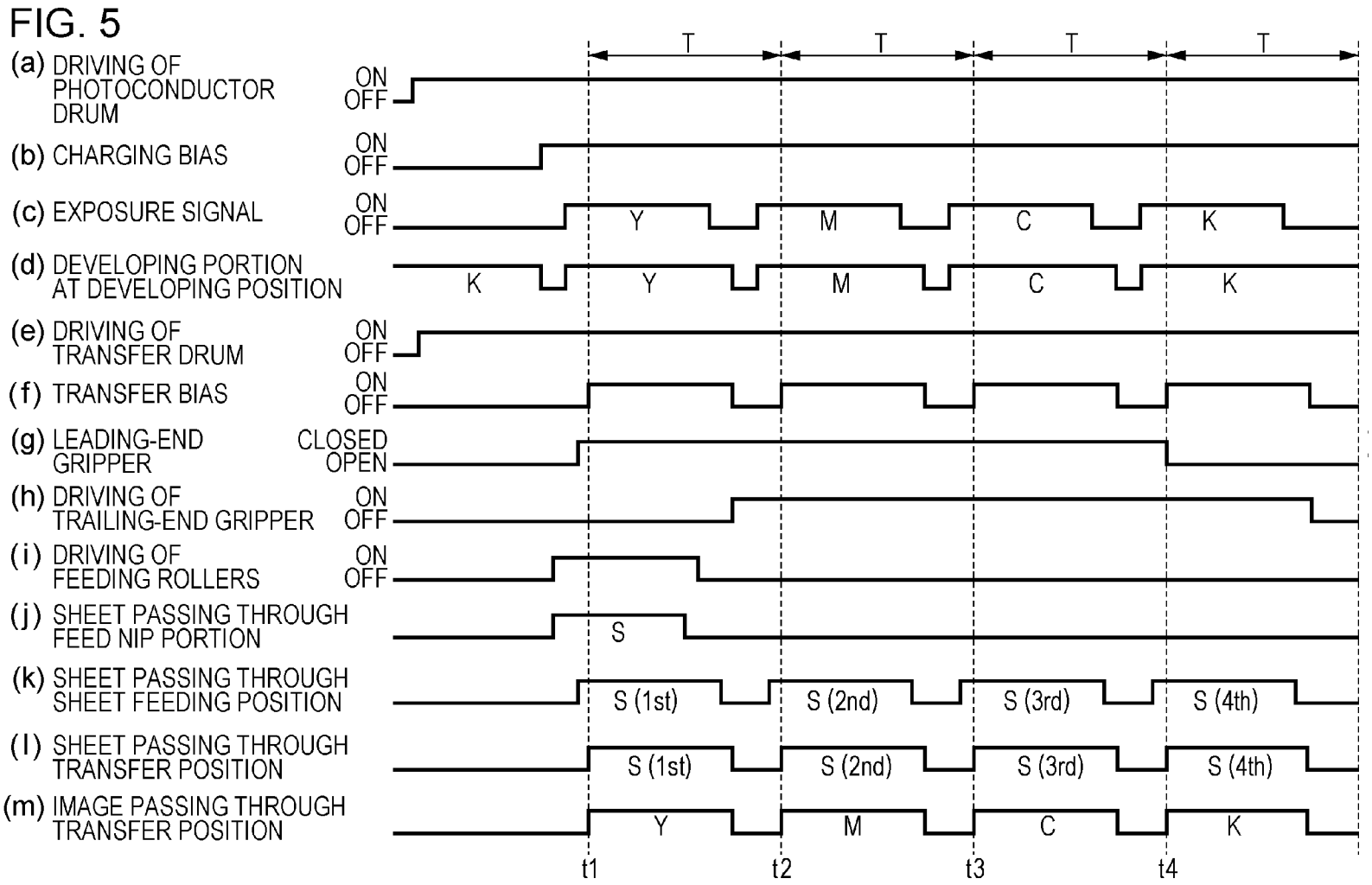
FIG. 5 is a timing chart illustrating an example of a procedure of an image forming operation for forming a full color image.

FIG. 5 is a timing chart illustrating an exemplary procedure of an operation for forming a full color image.

FIG. 5 illustrates the time-flow relationship between the following items: (a) driving of the photoconductor drum (ON/OFF); (b) application of a charging bias to the charging device 12 (ON/OFF); (c) supply of an exposure signal to the exposure device 13 (ON/OFF); (d) the developing portion positioned at the developing position; (e) driving of the transfer drum 21 (ON/OFF); (f) application of a transfer bias to the transfer drum 21 (ON/OFF); (g) the state of the leading-end gripper 22 (open/closed); (h) driving of the trailing-end gripper 23 (ON/OFF); (i) driving of the feed rollers 53 (ON/OFF); (j) a sheet S passing through the feed nip portion N; (k) the sheet S passing through the sheet feeding position P (the sheet S detected by the sheet detecting sensor 32); (l) the sheet S passing through the transfer position Tr; and (m) an image on the photoconductor drum 11 passing through the transfer position Tr.

In the illustrated example, in an initial state in which the image forming operation has not started yet, driving of all the photoconductor drum 11, the transfer drum 21, and the feed rollers 53 is turned off (OFF). In the initial state before the operation, application of a charging bias to the charging device 12, supply of an exposure signal to the exposure device 13, and application of a transfer bias to the transfer drum 21 are all turned off (OFF). Further, in the initial state before the operation, the black developing portion 14K is stationary at the developing position (see FIG. 1), the leading-end gripper 22 is set to be in the open state, and the trailing-end gripper 23 is stationary at the waiting position W (see FIG. 1).

In FIG. 5, "Y", "M", "C", and "K" respectively correspond to yellow, magenta, cyan, and black. Also in FIG. 5, "1st", "2nd", "3rd", and "4th" each denote the number of times one sheet S passes through the sheet feeding position P and the transfer position Tr on the outer peripheral surface of the transfer drum 21. For example, "S (2nd)" in (l) "the sheet passing through the transfer position" illustrated in FIG. 5 denotes that the sheet S that has already passed through the transfer position Tr once is currently passing through the transfer position Tr again (second time). In the following description, a time period that the transfer drum 21 takes to make one rotation while being driven is referred to as a transfer drum rotation period T. In FIG. 5, a time period from when the elastic-layer leading end 21BL of the elastic layer 21B of the transfer drum 21 arrives at the transfer position Tr to when the elastic-layer leading end 21BL returns to the transfer position Tr again is expressed as the transfer drum rotation period T.

With the start of the image forming operation, the controller 100 switches driving of the photoconductor drum 11 and the transfer drum 21 from OFF to ON and thus rotates the photoconductor drum 11 and the transfer drum 21. At this time, the photoconductor drum 11 and the transfer drum 21 are in contact with each other and rotate in the same direction at the transfer position Tr. Subsequently, the controller 100 rotates the rotary developing device 14 so that the yellow developing portion 14Y is positioned at the developing position. The controller 100 then starts applying a charging bias to the charging device 12 and supplying an exposure signal to the exposure device 13. The exposure signal that the controller 100 has supplied to the exposure device 13 at this time is an exposure signal for yellow (Y) that has been generated on the basis of output image data.

With the supply of the exposure signal, the photosensitive layer of the rotating photoconductor drum 11 is charged by the charging device 12 and then exposed by the exposure device 13. Thus, a yellow electrostatic latent image based on the output image data is formed on the photoconductor drum 11. Then, the electrostatic latent image formed on the photoconductor drum 11 is developed by the yellow developing portion 14Y and thus a yellow toner image based on the output image data is formed on the photoconductor drum 11. Thereafter, the yellow toner image formed on the photoconductor drum 11 is moved toward the transfer position Tr along further rotation of the photoconductor drum 11.

The controller 100 causes the sheet feeding unit 50 to perform feeding of the sheet S in response to the start of an output image forming operation of a full color image. To be more specific, the controller 100 causes the pick-up roller 52 to pick up a sheet S contained in the sheet containing portion 51 so that the sheet S proceeds to the sheet feeding path 61. Here, the controller 100 maintains driving of the feed rollers 53 as OFF. Thus, the leading end portion of the sheet S that has proceeded along the sheet feeding path 61 is stopped by coming into contact with the feed rollers 53 on the entry side of the feed nip portion N and thus the sheet S is subjected to skew correction. Then, the controller 100 switches driving of the feed rollers 53 from OFF to ON such that the leading end portion of the sheet S arrives at the sheet feeding position P concurrently with the arrival of the leading-end gripper 22 attached to the rotating transfer drum 21 at the sheet feeding position P. Thus, the feed rollers 53 are rotated. With the rotation of the feed rollers 53, feeding of the sheet S is restarted, and thus the sheet S passes through the feed nip portion N along the sheet feeding path 61 and arrives at the sheet feeding position P. Then, the controller 100 shifts the leading-end gripper 22 from the open state to the closed state concurrently with the arrival of the leading end portion of the sheet S at the sheet feeding position P. Thus, the leading end portion of the sheet S is mechanically held on the transfer drum 21. Here, the leading end portion side of the sheet S is transported along the rotational path 63 while being wound around the elastic layer 21B of the transfer drum 21, and a trailing end portion side of the sheet S is transported along the sheet feeding path 61 while being nipped by the feed rollers 53 at the feed nip portion N.

Subsequently, the leading end portion of the sheet S gripped by the leading-end gripper 22 against the transfer drum 21 passes through the sheet feeding position P, passes under the trailing-end gripper 23 that is being stationary at the waiting position W, and then arrives at the transfer position Tr at a first time point t1 (for the first time). During this time, the controller 100 is controlling the exposure device 13 on the basis of a phase signal output from the phase sensor 31 such that a leading end portion, in the moving direction, of a yellow-toner-image forming region on the photoconductor drum 11 arrives at the transfer position Tr concurrently with the arrival of the leading end portion of the sheet S held on the transfer drum 21 at the transfer position Tr. Then, the controller 100 switches the application of the transfer bias to the transfer drum 21 from OFF to ON at the timing when the leading end portion of the sheet S arrives at the transfer position Tr. Thus, transfer of the yellow toner image (first color) to the sheet S is started at the transfer position Tr.

In the illustrated example, after the leading end portion of the sheet S arrives at the transfer position Tr, a trailing end portion of the sheet S passes through the feed nip portion N, and then also through the sheet feeding position P. During this time, the controller 100 switches driving of the feed rollers 53 from ON to OFF and thus stops the rotation of the feed rollers 53 after the trailing end portion of the sheet S has passed through the feed nip portion N. Then, the controller 100 rotates the trailing-end gripper 23 at the same speed and in the same direction as the transfer drum 21 rotates, at the timing when the trailing end portion of the sheet S arrives in the facing region in which the trailing end portion faces the trailing-end gripper 23 that is stationary at the waiting position W. Thus, the trailing end portion of the sheet S is mechanically held on the transfer drum 21. Accordingly, the leading end portion of the sheet S is gripped by the leading-end gripper 22 and the trailing end portion of the sheet S is gripped by the trailing-end gripper 23. As a consequence, the entire sheet S is transported along the rotational path 63 while being wound around the elastic layer 21B of the transfer drum 21.

In the illustrated example, after the trailing end portion of the sheet S arrives at the sheet feeding position P, the operations of forming (exposing) the yellow electrostatic latent image and developing the yellow toner image for the sheet S are finished. Thus, the controller 100 finishes supplying the exposure device 13 with the exposure signal for yellow. Subsequently, the trailing end portion of the sheet S held on the transfer drum 21 passes through the transfer position Tr. At the timing when the trailing end portion of the sheet S passes through the transfer position Tr, the controller 100 switches the application of the transfer bias to the transfer drum 21 from ON to OFF. Thus, the transfer of the yellow toner image to the sheet S is finished. In the illustrated example, with the completion of the transfer of the yellow toner image to the sheet S, the controller 100 drives the rotary developing device 14 and changes the developing portion from one to another that is to be positioned at the developing position (switches from the yellow developing portion 14Y to the magenta developing portion 14M). Part of the yellow toner that was not transferred from the photoconductor drum 11 to the transfer drum 21 in the transfer operation is removed during the rotation of the photoconductor drum 11 by the cleaning device 15 that is attached to the photoconductor drum 11.

During a time period when the transfer bias is applied to the transfer drum 21, the yellow image (denoted by Y in (m) in FIG. 5) formed on the photoconductor drum 11 passes through the transfer position Tr and the sheet S passes through the transfer position Tr for the first time (as denoted by S (1st) in (l) in FIG. 5). Accordingly, the sheet S that has passed through the transfer position Tr has the yellow toner image transferred thereto.

The controller 100 continues applying the charging bias to the charging device 12 and starts supplying an exposure signal to the exposure device 13. The exposure signal that the controller 100 supplies to the exposure device 13 at this time is an exposure signal for magenta (M) generated on the basis of the output image data.

With the supply of the exposure signal, the photosensitive layer of the rotating photoconductor drum 11 is charged by the charging device 12 and then exposed by the exposure device 13. Thus, a magenta electrostatic latent image based on the output image data is formed on the photoconductor drum 11. Then, the electrostatic latent image formed on the photoconductor drum 11 is developed by the magenta developing portion 14M and thus a magenta toner image based on the output image data is formed on the photoconductor drum 11. Thereafter, the magenta toner image formed on the photoconductor drum 11 is moved toward the transfer position Tr along further rotation of the photoconductor drum 11.

After the exposed portion 21C of the transfer drum 21 has passed through the transfer position Tr as the transfer drum 21 rotates, the leading end portion of the sheet S held on the transfer drum 21 and transported on the rotational path 63 arrives at the transfer position Tr at a second time point t2 (for the second time). During this time, the controller 100 is controlling the exposure device 13 on the basis of a phase signal output from the phase sensor 31 such that a leading end portion, in the moving direction, of a magenta-toner-image forming region on the photoconductor drum 11 arrives at the transfer position Tr concurrently with the arrival of the leading end portion of the sheet S held on the transfer drum 21 at the transfer position Tr. Then, the controller 100 switches the application of the transfer bias to the transfer drum 21 from OFF to ON at the timing when the leading end portion of the sheet S arrives at the transfer position Tr. Thus, transfer of the magenta toner image (second color) to the sheet S is started at the transfer position Tr.

In the illustrated example, after the trailing end portion of the sheet S arrives at the sheet feeding position P, the operations of forming (exposing) the magenta electrostatic latent image and developing the magenta toner image for the sheet S are finished. Thus, the controller 100 finishes supplying the exposure device 13 with the exposure signal for magenta. Subsequently, the trailing end portion of the sheet S held on the transfer drum 21 passes through the transfer position Tr. At the timing when the trailing end portion of the sheet S passes through the transfer position Tr, the controller 100 switches the application of the transfer bias to the transfer drum 21 from ON to OFF. Thus, the transfer of the magenta toner image to the sheet S is finished. In the illustrated example, with the completion of the transfer of the magenta toner image to the sheet S, the controller 100 drives the rotary developing device 14 and changes the developing portion from one to another that is to be positioned at the developing position (switches from the magenta developing portion 14M to the cyan developing portion 14C). Part of the magenta toner that was not transferred from the photoconductor drum 11 to the transfer drum 21 in the transfer operation is removed during the rotation of the photoconductor drum 11 by the cleaning device 15 that is attached to the photoconductor drum 11.

During a time period when the transfer bias is applied to the transfer drum 21, the magenta image (denoted by M in (m) in FIG. 5) formed on the photoconductor drum 11 passes through the transfer position Tr and the sheet S passes through the transfer position Tr for the second time (as denoted by S (2nd) in (l) in FIG. 5). Accordingly, the sheet S that has passed through the transfer position Tr has the magenta toner image transferred thereto, in addition to the yellow toner image that has already been transferred thereto.

The controller 100 continues applying the charging bias to the charging device 12 and starts supplying an exposure signal to the exposure device 13. The exposure signal that the controller 100 has supplied to the exposure device 13 at this time is an exposure signal for cyan (C) generated on the basis of the output image data.

With the supply of the exposure signal, the photosensitive layer of the rotating photoconductor drum 11 is charged by the charging device 12 and then exposed by the exposure device 13. Thus, a cyan electrostatic latent image based on the output image data is formed on the photoconductor drum 11. Then, the electrostatic latent image formed on the photoconductor drum 11 is developed by the cyan developing portion 14C and thus a cyan toner image based on the output image data is formed on the photoconductor drum 11. Thereafter, the cyan toner image formed on the photoconductor drum 11 is moved toward the transfer position Tr along further rotation of the photoconductor drum 11.

After the exposed portion 21C of the transfer drum 21 has passed through the transfer position Tr as the transfer drum 21 rotates, the leading end portion of the sheet S held on the transfer drum 21 and transported on the rotational path 63 arrives at the transfer position Tr at a third time point t3 (for the third time). During this time, the controller 100 is controlling the exposure device 13 on the basis of a phase signal output from the phase sensor 31 such that a leading end portion, in the moving direction, of a cyan-toner-image forming region on the photoconductor drum 11 arrives at the transfer position Tr concurrently with the arrival of the leading end portion of the sheet S held on the transfer drum 21 at the transfer position Tr. Then, the controller 100 switches the application of the transfer bias to the transfer drum 21 from OFF to ON at the timing when the leading end portion of the sheet S arrives at the transfer position Tr. Thus, transfer of the cyan toner image (third color) to the sheet S is started at the transfer position Tr.

In the illustrated example, after the trailing end portion of the sheet S arrives at the sheet feeding position P, the operations of forming (exposing) the cyan electrostatic latent image and developing the cyan toner image for the sheet S are finished. Thus, the controller 100 finishes supplying the exposure device 13 with the exposure signal for cyan. Subsequently, the trailing end portion of the sheet S held on the transfer drum 21 passes through the transfer position Tr. At the timing when the trailing end portion of the sheet S passes through the transfer position Tr, the controller 100 switches the application of the transfer bias to the transfer drum 21 from ON to OFF. Thus, the transfer of the cyan toner image to the sheet S is finished. In the illustrated example, with the completion of the transfer of the cyan toner image to the sheet S, the controller 100 drives the rotary developing device 14 and changes the developing portion from one to another that is to be positioned at the developing position (switches from the cyan developing portion 14C to the black developing portion 14K). Part of the cyan toner that was not transferred from the photoconductor drum 11 to the transfer drum 21 in the transfer operation is removed during the rotation of the photoconductor drum 11 by the cleaning device 15 that is attached to the photoconductor drum 11.

During a time period when the transfer bias is applied to the transfer drum 21, the cyan image (denoted by C in (m) in FIG. 5) formed on the photoconductor drum 11 passes through the transfer position Tr and the sheet S passes through the transfer position Tr for the third time (as denoted by S (3rd) in (l) in FIG. 5). Accordingly, the sheet S that has passed through the transfer position Tr has the cyan toner image transferred thereto, in addition to the yellow and magenta toner images that have already been transferred thereto.

The controller 100 continues applying the charging bias to the charging device 12 and starts supplying an exposure signal to the exposure device 13. The exposure signal that the controller 100 has supplied to the exposure device 13 at this time is an exposure signal for black (K) generated on the basis of the output image data.

With the supply of the exposure signal, the photosensitive layer of the rotating photoconductor drum 11 is charged by the charging device 12 and then exposed by the exposure device 13. Thus, a black electrostatic latent image based on the output image data is formed on the photoconductor drum 11. Then, the electrostatic latent image formed on the photoconductor drum 11 is developed by the black developing portion 14K and thus a black toner image corresponding to the black electrostatic latent image based on the output image data is formed on the photoconductor drum 11. Thereafter, the black toner image formed on the photoconductor drum 11 is moved toward the transfer position Tr along further rotation of the photoconductor drum 11.

After the exposed portion 21C of the transfer drum 21 has passed through the transfer position Tr as the transfer drum 21 rotates, the leading end portion of the sheet S held on the transfer drum 21 and transported on the rotational path 63 arrives at the transfer position Tr at a fourth time point t4 (for the fourth time). During this time, the controller 100 is controlling the exposure device 13 on the basis of a phase signal output from the phase sensor 31 such that a leading end portion, in the moving direction, of a black-toner-image forming region on the photoconductor drum 11 arrives at the transfer position Tr concurrently with the arrival of the leading end portion of the sheet S held on the transfer drum 21 at the transfer position Tr. Then, the controller 100 switches the application of the transfer bias to the transfer drum 21 from OFF to ON at the timing when the leading end portion of the sheet S arrives at the transfer position Tr. Thus, transfer of the black toner image (fourth color) to the sheet S is started at the transfer position Tr.

In the illustrated example, the controller 100 switches the state of the leading-end gripper 22 from the closed state to the open state at the timing when the leading end portion of the sheet S arrives at the transfer position Tr. Accordingly, the leading end portion of the sheet S stops from being held on the transfer drum 21, and thus the sheet S that has passed through the transfer position Tr moves away from the rotational path 63 toward the fixing unit 40 along the sheet output path 64. With passage of the sheet S through the fixing nip portion of the fixing unit 40, a full color toner image that has been transferred to the sheet S in a layered manner is fixed to the sheet S.

In the illustrated example, after the trailing end portion of the sheet S has arrived at the sheet feeding position P, the operations of forming (exposing) the black electrostatic latent image and developing the black toner image for the sheet S are finished. Thus, the controller 100 finishes supplying the exposure device 13 with the exposure signal for black. Subsequently, at the timing when the trailing end portion of the sheet S arrives at the waiting position W, the controller 100 stops rotating the trailing-end gripper 23. Accordingly, the trailing-end gripper 23 becomes stationary at the waiting position W again. At this time, the sheet S is transported while being nipped by the photoconductor drum 11 and the transfer drum 21 at the transfer position Tr. Thus, the trailing end portion of the sheet S passes under the trailing-end gripper 23 (pressing sheet 230) that is stationary at the waiting position W. Then, at the timing when the trailing end portion of the sheet S arrives at the transfer position Tr, the controller 100 switches the application of the transfer bias to the transfer drum 21 from ON to OFF. Thus, the transfer of the black toner image to the sheet S is finished. Part of the black toner that was not transferred from the photoconductor drum 11 to the transfer drum 21 in the transfer operation is removed during the rotation of the photoconductor drum 11 by the cleaning device 15 that is attached to the photoconductor drum 11.

Thereafter, the sheet S passes through the fixing unit 40 along the sheet output path 64 and is then stacked on the output sheet stacker 3. Thus, the output image forming operation for one sheet S is complete. After the completion of the output image forming operation, all the components included in the image forming apparatus 1 are stationary after being reset to the initial state described above.

During a time period when the transfer bias is applied to the transfer drum 21, the black image (denoted by K in (m) in FIG. 5) formed on the photoconductor drum 11 passes through the transfer position Tr and the sheet S passes through the transfer position Tr for the fourth time (as denoted by S (4th) in (l) in FIG. 5). Accordingly, the sheet S that has passed through the transfer position Tr has the black toner image transferred thereto, in addition to the yellow, magenta, and cyan toner images that have already been transferred thereto.

Hereinbelow, an operation of feeding a sheet S to the transfer drum 21 and an operation performed by the transfer drum 21 to hold the sheet S in the above-described image forming operation will be described further in detail.

FIGS. 6A to 6D and 7A to 7D illustrate a procedure for feeding a sheet S to the transfer drum 21 and holding the sheet S on the transfer drum 21. FIGS. 6A to 6D and 7A to 7D illustrate the states around the first time point t1 in the timing chart illustrated in FIG. 5. In each of the states illustrated in FIGS. 6A to 6D and 7A to 7D, the photoconductor drum 11 is rotating in the arrow A direction and the transfer drum 21 is rotating in the arrow B direction.

Figure 6A:
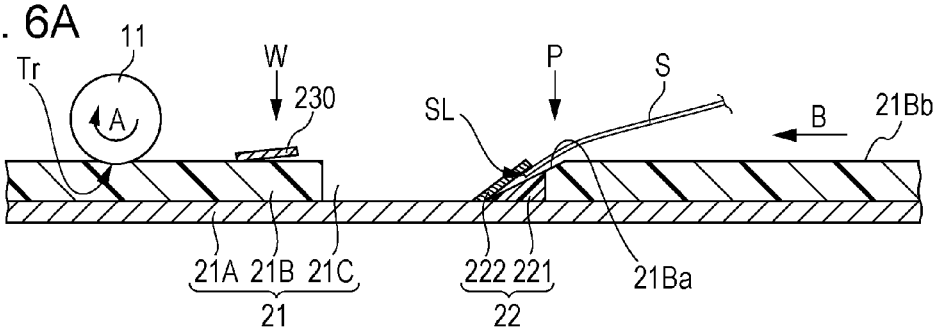
FIGS. 6A, 6B, 6C, and 6D illustrate a procedure for feeding a sheet to a transfer drum and holding the sheet on the transfer drum.

FIG. 6A illustrates the state where a leading end portion SL of the sheet S has arrived at the sheet feeding position P. Here, the leading-end gripper 22 is in the open state, and the pressing sheet 230 of the trailing-end gripper 23 is stationary at the waiting position W.

In the state illustrated in FIG. 6A, the sheet S is moved while being nipped by the feed rollers 53 (see FIG. 1). In the exemplary embodiment, the rotational speed of the feed rollers 53 (the speed at which a sheet S is fed) is set to be slightly higher than the rotational speed (peripheral velocity) of the transfer drum 21. Thus, the leading end portion SL of the sheet S that has been fed along the sheet feeding path 61 (see FIG. 1) enters the leading-end gripper (enters a space between the platform 221 and the nip board 222) that is in the open state, at the sheet feeding position P. Then, the state of the leading-end gripper 22 is changed from the open state to the closed state, so that the leading end portion SL of the sheet S is held by the leading-end gripper 22.

Figure 6B:
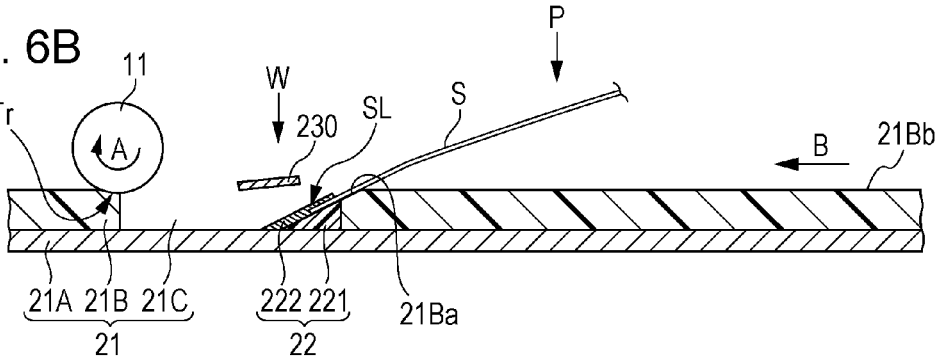

FIG. 6B illustrates the state during a period from when the leading end portion SL of the sheet S passes through the sheet feeding position P to when the leading end portion SL of the sheet S arrives at the waiting position W. Here, the leading-end gripper 22 is in the closed state and the pressing sheet 230 of the trailing-end gripper 23 is stationary at the waiting position W.

In the state illustrated in FIG. 6B, the sheet S is moved while having a leading end portion SL thereof gripped by the leading-end gripper 22 and a trailing end portion SL thereof nipped by the feed rollers 53 (see FIG. 1). Here, the rotational speed of the transfer drum 21 and that of the feed rollers 53 are different from each other, as described above. For this reason, a region of the sheet S located between the leading end portion SL of the sheet S held by the leading-end gripper 22 onto the transfer drum 21 and a portion of the sheet S that is nipped by the feed rollers 53 sags, and this sagging region of the sheet S is not in contact with the elastic layer 21B of the transfer drum 21.

Figure 6C:
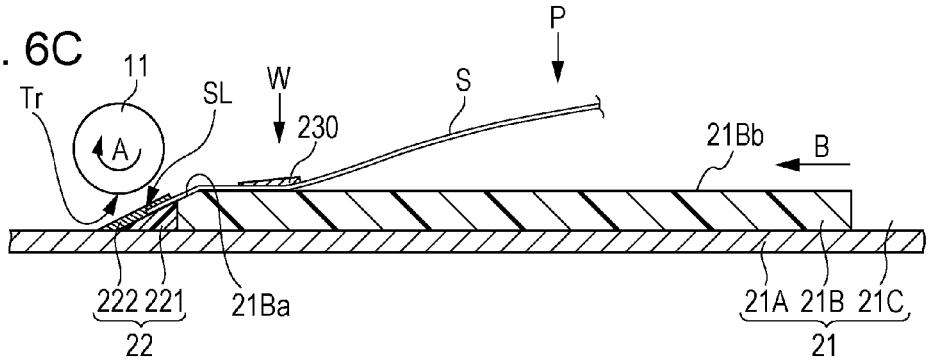

FIG. 6C illustrates the state during a period from when the leading end portion SL of the sheet S passes through the waiting position W to when the leading end portion SL of the sheet S arrives at the transfer position Tr. Here, the leading-end gripper 22 is in the closed state and the pressing sheet 230 of the trailing-end gripper 23 is stationary at the waiting position W.

In the state illustrated in FIG. 6C, the sheet S is moved while having its leading end portion SL gripped by the leading-end gripper 22, a portion of the sheet S that is passing through the waiting position W pressed against the elastic layer 21B by the pressing sheet 230, and a portion that is closer to the trailing end portion nipped by the feed rollers 53 (see FIG. 1). At this time, a region of the sheet S that faces the flat surface 21Bb of the elastic layer 21B is passing under the pressing sheet 230 that is stationary at the waiting position W, while the sheet S is having its leading end portion SL held by the leading-end gripper 22.

Prior to the state illustrated in FIG. 6C, the leading-end gripper 22 that holds the leading end portion SL of the sheet S passes under the pressing sheet 230 of the trailing-end gripper 23 that is stationary at the waiting position W. Following the leading-end gripper 22, a region of the sheet S that faces the inclined surface 21Ba of the elastic layer 21B passes under the pressing sheet 230 that is stationary at the waiting position W, while the leading end portion SL of the sheet S is being held by the leading-end gripper 22. Here, in the exemplary embodiment, the pressing sheet 230 is stationary while being tilted in the same direction as the inclination of the inclined surface 21Ba of the elastic layer 21B that is moved in the arrow B direction. For this reason, the elastic layer 21B is not caught by the pressing sheet 230 when passing through the facing region in which the elastic layer 21B faces the pressing sheet 230, while the sheet S is pressed by the pressing sheet 230 against the elastic layer 21B.

Subsequently, the sheet S having its leading end portion SL gripped by the leading-end gripper 22 proceeds to a space between the elastic layer 21B of the transfer drum (flat surface 21Bb) and the downstream-side end portion of the pressing sheet 230, which are in contact with each other. When the sheet S proceeds to the space therebetween, the elastic layer 21B and the pressing sheet 230 are deformed due to the elasticity of the elastic layer 21B itself and the flexibility of the pressing sheet 230 itself, and thus, a gap that is equivalent to the thickness of the sheet S is generated therebetween. Consequently, the sheet S passes through the facing region in which the elastic layer 21B faces the pressing sheet 230 while being pressed against the elastic layer 21B by the pressing sheet 230. In the exemplary embodiment, the frictional force exerted between the sheet S and the pressing sheet 230 is smaller than the frictional force exerted between the elastic layer 21B and the sheet S. For this reason, the sheet S having its leading end portion SL held by the leading-end gripper 22 is pressed against the elastic layer 21B by the pressing sheet 23, and is moved in the arrow B direction while the pressing sheet 230 is in slidable contact with the sheet S.

As described above, the sheet S has a sagging region due to the speed difference between the transfer drum 21 and the feed rollers 53. However, the pressing sheet 230 that is stationary at the waiting position W applies a force in a direction opposite to the arrow B direction to the sheet S having its leading end portion SL held by the leading-end gripper 22 while being in contact with the sheet S. Thus, a region of the sheet S that has passed through the waiting position W no longer sags, and thus comes into surface contact with the flat surface 21Bb of the elastic layer 21B without floating.

Figure 6D:
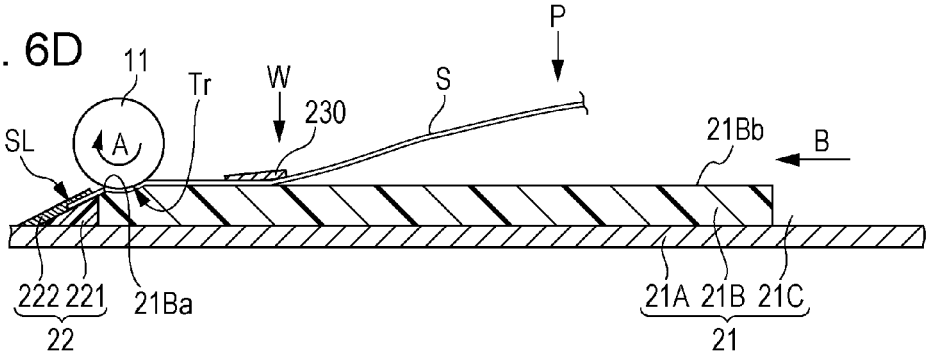

FIG. 6D illustrates a state during a period from when the leading end portion SL of the sheet S passes through the transfer position Tr to when a trailing end portion ST of the sheet S (see FIG. 7A to be described below) arrives at the feed nip portion N (see FIG. 1). During this time, the leading-end gripper 22 is in the closed state, and the pressing sheet 230 of the trailing-end gripper 23 is stationary at the waiting position W.

In the state illustrated in FIG. 6D, the sheet S is moved while having its leading end portion SL gripped by the leading-end gripper 22, a portion of the sheet S that is passing through the waiting position W pressed against the elastic layer 21B by the pressing sheet 230, and a portion that is closer to the trailing end portion nipped by the feed rollers 53 (see FIG. 1). As the leading end portion SL of the sheet S passes through the transfer position Tr, the photoconductor drum 11 starts transferring an image (yellow toner image, for example) to the sheet S therefrom. Since the region of the sheet S that has passed through the transfer position Tr is in surface contact with the elastic layer 21B for the reason as described above, the region of the sheet S that has passed through the transfer position Tr is less likely to have creases or other defects.

Figure 7A:
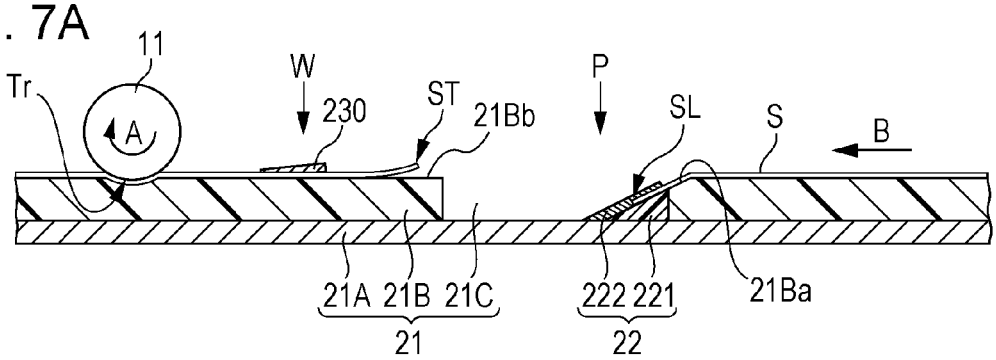
FIGS. 7A, 7B, 7C, and 7D illustrate a procedure, which follows the procedure illustrated in FIGS. 6A to 6D, for feeding the sheet to the transfer drum and holding the sheet on the transfer drum.

FIG. 7A illustrates the state during a period from when the trailing end portion ST of the sheet S passes through the feed nip portion N (see FIG. 1) to when the trailing end portion ST of the sheet S arrives at the waiting position W. During this time, the leading-end gripper 22 is in the closed state and the pressing sheet 230 of the trailing-end gripper 23 is stationary at the waiting position W.

In the state illustrated in FIG. 7A, the sheet S is moved while having its leading end portion SL gripped by the leading-end gripper 22, a portion of the sheet S that is passing through the transfer position Tr pressed against the elastic layer 21B by the photosensitive drum 11, and a portion that is passing through the waiting position W pressed against the elastic layer 21B by the pressing sheet 230. During this time, the yellow toner image is continuously being transferred to the sheet S from the photoconductor drum 11.

Figure 7B:
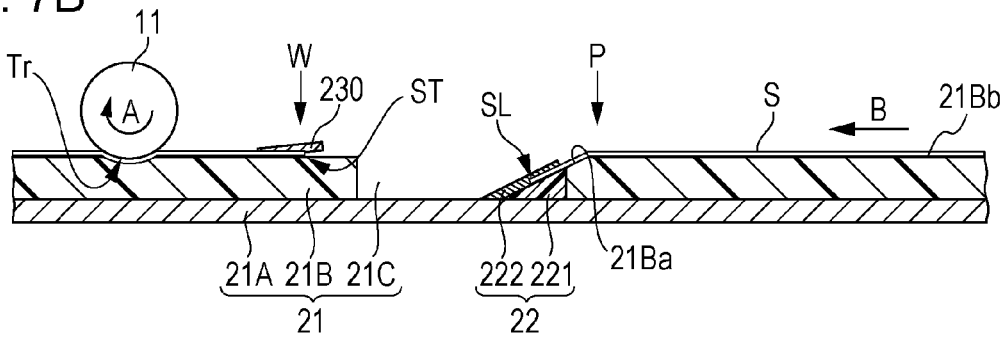

FIG. 7B illustrates a state where the trailing end portion ST of the sheet S arrives at the waiting position W. Here, the leading-end gripper 22 is in the closed state and the state of the pressing sheet 230 of the trailing-end gripper 23 is changed from the state in which the pressing sheet 230 is stationary at the waiting position W to the state in which the pressing sheet 230 rotates in the arrow B direction.

In the state illustrated in FIG. 7B, the sheet S is moved while having its leading end portion SL gripped by the leading-end gripper 22 and a portion that is on the trailing end portion ST side and passing through the waiting position W (a portion that is located further downstream than the trailing end portion ST by about a few millimeters) pressed against the elastic layer 21B by the pressing sheet 230. In this state, the state of the trailing-end gripper 23 is changed from the state in which the trailing-end gripper 23 is stationary at the waiting position W to the state in which the trailing-end gripper 23 rotates in the same direction and at the same rotational speed as the transfer drum 21 rotates. Accordingly, the leading end portion SL of the sheet S is held by the leading-end gripper 22 and also the trailing end portion ST of the sheet S is held by the trailing-end gripper 23.

Figure 7C:
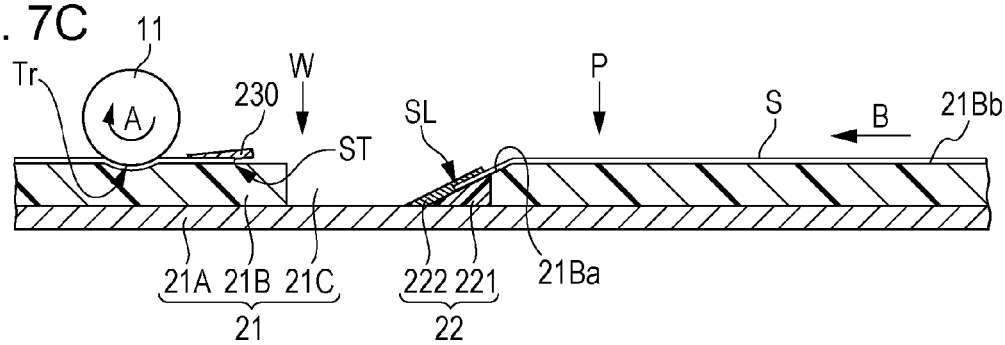

FIG. 7C illustrates the state during a period from when the trailing end portion ST of the sheet S passes through the waiting position W to when the trailing end portion ST of the sheet S arrives at the transfer position Tr. In this state, the leading-end gripper 22 is in the closed state and the pressing sheet 230 of the trailing-end gripper 23 rotates in the arrow B direction.

In the state illustrated in FIG. 7C, the sheet S is moved while having its leading end portion SL gripped by the leading-end gripper 22 and its trailing end portion ST gripped by the trailing-end gripper 23. Here, the sheet S is attached to the elastic layer 21B along the flat surface 21Bb. During this time, the yellow toner image is continuously being transferred to the sheet S from the photoconductor drum 11.

Figure 7D:
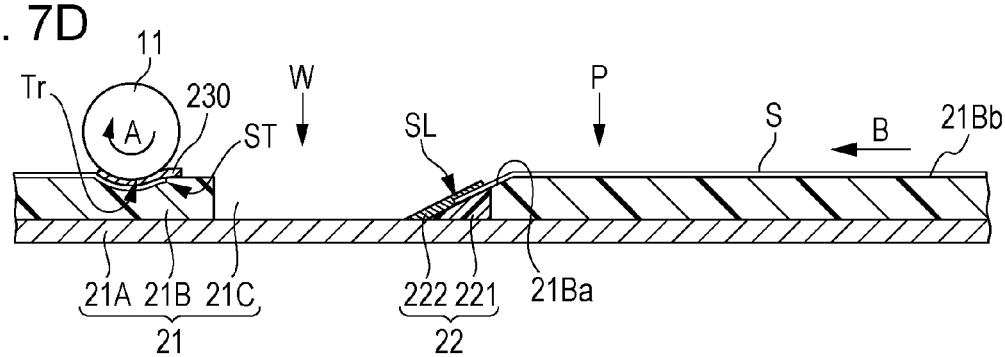

FIG. 7D illustrates the state where the trailing end portion ST of the sheet S is passing through the transfer position Tr. Here, the leading-end gripper 22 is in the closed state and the pressing sheet 230 of the trailing-end gripper 23 is rotating in arrow B direction.

In the state illustrated in FIG. 7D, the sheet S is moved while having its leading end portion SL gripped by the leading-end gripper 22 and its trailing end portion ST gripped by the trailing-end gripper 23. Also, in this state, the pressing sheet 230 pressing the trailing end portion ST of the sheet S is passing through the transfer position Tr. Here, the pressing sheet 230 is deformed with the elasticity of the elastic layer 21B and the flexibility of pressing sheet 230 itself so as to follow the shape of the photoconductor drum 11. By this time, the transfer of the yellow toner image to the sheet S has been complete.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrying member that is disposed rotatably and carries an image on an outer peripheral surface thereof;

a transfer member that is rotatably disposed so as to face the image carrying member, the transfer member transferring the image carried on the image carrying member to a recording medium that is interposed between the transfer member and the image carrying member at a transfer position at which the transfer member faces the image carrying member;

a leading-end holding member that is mounted on the transfer member and holds a leading-end portion, in a transport direction, of the recording medium on an outer peripheral surface of the transfer member, the recording medium being fed to a sheet feeding position that is further upstream than the transfer position in a rotation direction of the transfer member; and a trailing-end holding member that is disposed so as to be capable of rotating along the outer peripheral surface of the transfer member, the trailing-end holding member pressing the recording medium having the leading end portion in the transport direction held by the leading-end holding member against the outer peripheral surface of the transfer member while waiting at a waiting position that is further upstream than the transfer position and further downstream than the sheet feeding position in the rotation direction of the transfer member, the trailing-end holding member holding a trailing end portion, in the transport direction, of the recording medium onto the outer peripheral surface of the transfer member while rotating so as to follow rotation of the transfer member when the trailing end portion, in the transport direction, of the recording medium arrives at the waiting position, wherein the trailing-end holding member includes a strip-like member that faces the outer peripheral surface of the transfer member and that extends in a direction parallel to a rotation axis of the transfer member, and wherein the strip-like member is obliquely disposed such that a portion of the strip-like member that is on the downstream side in the rotation direction of the transfer member is closer to the transfer member than a portion of the strip-like member that is on the upstream side in the rotation direction of the transfer member.

2. The image forming apparatus according to claim 1, wherein the strip-like member is disposed so as to be in contact with the outer peripheral surface of the transfer member.

3. The image forming apparatus according to claim 1, wherein the transfer member includes a substantially cylindrical base member and an elastic layer that has elasticity and that is mounted on an outer peripheral surface of the base member except for a partial circumferential area of the outer peripheral surface, and wherein a portion of the elastic layer that is on an upstream side in the rotation direction of the transfer member has an inclined surface that is formed such that the thickness of the elastic layer increases from the downstream side to the upstream side in the rotation direction of the transfer member.

4. The image forming apparatus according to claim 2, wherein the transfer member includes a substantially cylindrical base member and an elastic layer that has elasticity and that is mounted on an outer peripheral surface of the base member except for a partial circumferential area of the outer peripheral surface, and wherein a portion of the elastic layer that is on an upstream side in the rotation direction of the transfer member has an inclined surface that is formed such that the thickness of the elastic layer increases from the downstream side to the upstream side in the rotation direction of the transfer member.

5. An image forming apparatus comprising:

an image carrying member that is disposed rotatably and carries an image on an outer peripheral surface thereof;

a transfer member that is rotatably disposed so as to face the image carrying member, the transfer member transferring the image carried on the image carrying member to a recording medium that is interposed between the transfer member and the image carrying member at a transfer position at which the transfer member faces the image carrying member;

a leading-end holding member that holds a leading-end portion, in a transport direction, of the recording medium that is fed to the transfer member, onto an outer peripheral surface of the transfer member; and a trailing-end holding member that is disposed so as to face the outer peripheral surface of the transfer member, the trailing-end holding member exerting a force in a direction opposite to a rotation direction of the transfer member on the recording medium having the leading end portion in the transport direction held by the leading-end holding member, while coming into contact with the recording medium when the recording medium passes through a waiting position as the transfer member rotates, the trailing-end holding member holding a trailing end portion, in the transport direction, of the recording medium onto the outer peripheral surface of the transfer member while rotating so as to follow rotation of the transfer member when the trailing end portion, in the transport direction, of the recording medium arrives at the waiting position, wherein the trailing-end holding member includes a strip-like member that faces the outer peripheral surface of the transfer member and that extends in a direction parallel to a rotation axis of the transfer member, and wherein the strip-like member is obliquely disposed such that a portion of the strip-like member that is on the downstream side in the rotation direction of the transfer member is closer to the transfer member than a portion of the strip-like member that is on the upstream side in the rotation direction of the transfer member.

6. The image forming apparatus according to claim 5, wherein the strip-like member is configured to receive a tension applied in a direction along the rotation axis of the transfer member.

* * * * *